US009472890B2

(12) United States Patent
Arai et al.

(10) Patent No.: US 9,472,890 B2
(45) Date of Patent: Oct. 18, 2016

(54) CONNECTOR FOR CABLE CONNECTION

(71) Applicant: SMK Corporation, Tokyo (JP)

(72) Inventors: Atsushi Arai, Toyama (JP); Tetsuya Takagi, Toyama (JP); Tomohiro Imamura, Toyama (JP)

(73) Assignee: SMK Corporation, Tokyo (JP)

( * ) Notice: Subject to any disclaimer, the term of this patent is extended or adjusted under 35 U.S.C. 154(b) by 0 days.

(21) Appl. No.: 14/814,513

(22) Filed: Jul. 31, 2015

(65) Prior Publication Data

US 2016/0118743 A1 Apr. 28, 2016

(30) Foreign Application Priority Data

Oct. 24, 2014 (JP) ..... 2014-216949

(51) Int. Cl.
*H01R 13/40* (2006.01)
*H01R 13/52* (2006.01)
*H01R 13/506* (2006.01)

(52) U.S. Cl.
CPC ..... *H01R 13/5205* (2013.01); *H01R 13/506* (2013.01)

(58) Field of Classification Search
CPC ..... H01R 13/5208; H01R 13/5205; H01R 13/5221; H01R 13/521; H01R 13/5219
USPC ..... 439/587, 584; 339/103
See application file for complete search history.

(56) References Cited

U.S. PATENT DOCUMENTS 2,152,504 A * 3/1939 Scott ..... H01R 24/40 174/19
2,195,630 A * 4/1940 Papp ..... H01R 4/5025 174/84 S
2,717,367 A * 9/1955 Puerner ..... H01R 13/5202 285/918
3,129,993 A * 4/1964 Ross ..... H01R 13/64 285/360
3,307,137 A * 2/1967 Tordoff ..... H01R 13/53 174/18
3,761,865 A * 9/1973 Bomgaars ..... H02G 7/18 174/40 R
3,835,439 A * 9/1974 Yonkers ..... H01H 9/085 439/187
3,905,672 A * 9/1975 Anhalt ..... B60T 8/171 439/281
3,915,534 A * 10/1975 Yonkers ..... H01H 9/085 174/71 R
3,980,984 A * 9/1976 Bridges ..... G10K 11/004 367/155

(Continued)

FOREIGN PATENT DOCUMENTS

JP 2011-018463 A 1/2011

*Primary Examiner* — Abdullah Riyami
*Assistant Examiner* — Vladimir Imas

(57) ABSTRACT

A connector for cable connection having good connection workability is provided. A waterproof connector for cable connection includes a housing having a cylindrical portion for allowing a cable to which a terminal is connected to be attached thereto, a waterproof bushing, a cover member, and a clamp member. In a state that the cable is attached to the housing through the cylindrical portion, a front portion of the bushing is elastically attached to the outer periphery of the cylindrical portion, and a rear portion of the bushing is elastically attached to the outer periphery of the cable. The cover member has an attachment portion for the clamp member. The clamp member attached to the attachment portion clamps the cable.

1 Claim, 13 Drawing Sheets

(56) References Cited

U.S. PATENT DOCUMENTS 4,304,455 A * 12/1981 McLaughlin ..... H01R 13/5205 439/469
5,167,527 A * 12/1992 Clark ..... H01R 13/5205 29/857
5,642,780 A * 7/1997 Moore ..... E21B 17/003 166/65.1
6,916,203 B2 * 7/2005 Oyamada ..... H01R 13/502 439/263
7,097,486 B2 * 8/2006 Parsons ..... H01R 13/5202 439/291
7,156,696 B1 * 1/2007 Montena ..... H01R 9/05 174/59
7,422,466 B1 * 9/2008 Arai ..... H01R 13/5804 439/353
7,507,125 B2 * 3/2009 Okamura ..... H01R 13/506 439/680
7,857,647 B2 * 12/2010 Bracci ..... H01R 13/5205 439/274
8,475,192 B2 * 7/2013 Kantor ..... H01R 13/5205 439/273
9,017,102 B2 * 4/2015 Natoli ..... H01R 9/0524 439/578
9,257,780 B2 * 2/2016 Thomas ..... H01R 13/52
2010/0258157 A1 * 10/2010 Arai ..... H01R 13/52 136/244

* cited by examiner

<A-A CROSS-SECTIONAL VIEW>

<B-B CROSS-SECTIONAL VIEW>

CONNECTOR FOR CABLE CONNECTION

CROSS REFERENCE TO RELATED APPLICATION

The contents of the following Japanese patent application are incorporated herein by reference, NO. 2014-216949 filed on Oct. 24, 2014.

FIELD

The present invention relates to a waterproof connector for cable connection.

BACKGROUND

Waterproof connectors for cable connection are used for connecting a plurality of solar panels in a field, for example.

Patent Literature 1 discloses as an example a cable clamp connection structure that connects cables by double nuts and/or a ratchet mechanism.

However, such a screw-in type cable clamp connection structure requires long man-hours for a clamping operation, resulting in poor workability.

CITATION LIST

Patent Literature

Patent Literature 1: Japanese Patent Application Laid-Open No. 2011-18463

SUMMARY

Technical Problem

An object of the present invention is to provide a connector for cable connection having good connection workability.

Solution to Problem

A connector for cable connection according to one aspect of the present invention, being a waterproof connector for cable connection, includes a housing having a cylindrical portion for allowing a cable to which a terminal is connected to be attached thereto, a waterproof bushing, a cover member, and a clamp member. In a state that the cable is attached to the housing through the cylindrical portion, a front portion of the bushing is elastically attached to an outer periphery of the cylindrical portion, and a rear portion of the bushing is elastically attached to an outer periphery of the cable; the cover member has an attachment portion for the clamp member; and the clamp member attached to the attachment portion clamps the cable.

Here, the bushing ensures watertightness between the housing of the connector and the cable. However, since the inner periphery of the bushing elastically and tightly makes contact with the outer periphery of the cylindrical portion of the housing and the outer periphery of the cable, if a force acts in the direction of pulling out the cable, the cable might not be securely held in the housing.

Accordingly, one aspect of the present invention is characterized in that a clamp mechanism for clamping the cable is provided in the cover member.

In one aspect of the present invention, the structure of the clamp mechanism is not limited as long as the clamp mechanism can clamp the cable such that the cable cannot be pulled out of the housing.

As a structure that is easy to attach to the cover member, for example, the clamp member may clamp the cable by fitting a first clamp member and a second clamp member to each other.

Here, the first clamp member and the second clamp member constitute a two-step fitting structure having a pre-fitting portion and a fitting portion. The first clamp member and the second clamp member are attached to the attachment portion of the cover member in a state of fitting the pre-fitting portion. After the cable is inserted into and attached to the housing, the first clamp member and the second clamp member are fitted to each other by the fitting portion to clamp the cable. This structure makes it possible to attach the clamp member to the cover member in a pre-fitted state. Therefore, it is possible to bring the connector in a field, in a state that the front portion of the bushing is elastically attached to the cylindrical portion of the housing of the connector and the cover member having the pre-fitted clamp member is attached to the outer periphery of the bushing.

In the field, the cable to which the terminal is connected at a core wire is inserted into and attached to the housing from behind the connector. Then, just pushing the first and second clamp members in each other so as to make the clamp member into the fitted state completes the clamp connection of the cable.

According to the connector for cable connection of one aspect of the present invention, the bushing made of an elastic material provides watertightness between the housing and the outer periphery of the cable, and the clamp member attached to the cover member clamps the cable. Thus, the connector according to one aspect of the present invention is superior to a conventional screw-in type connector in clamp connection workability in a field.

DESCRIPTION OF EMBODIMENTS

Figure 7:
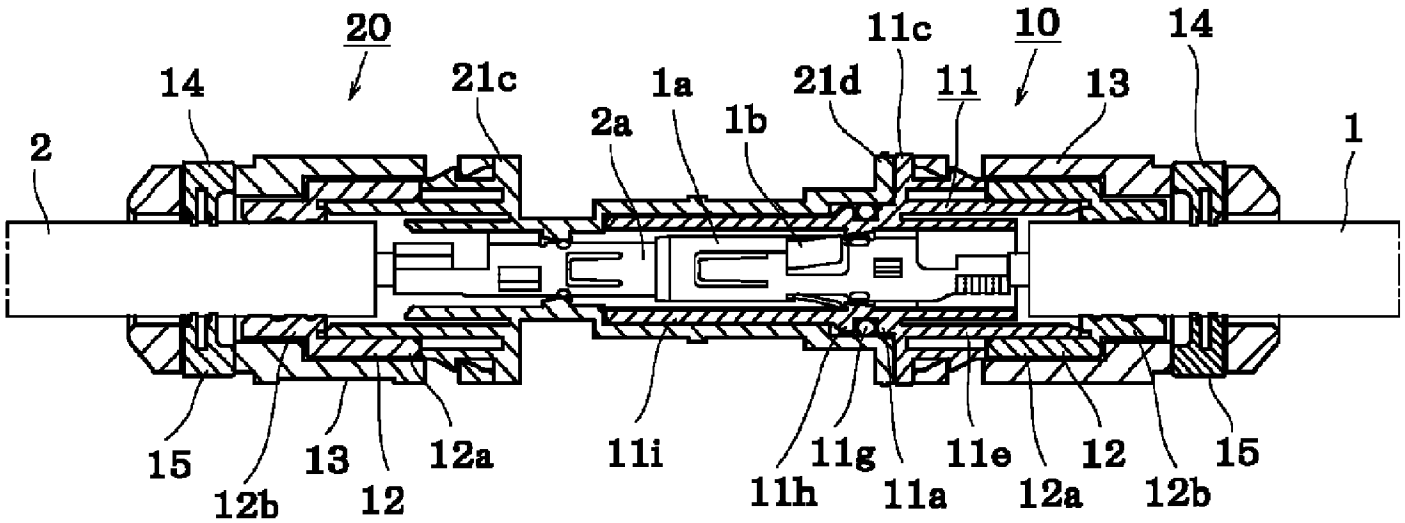
FIG. 7 shows a longitudinal cross-sectional view of FIG. 6B.

FIG. 7 shows a socket connector 10 and a plug connector 20, which adopt a connector structure according to one embodiment of the present invention, connected to each other. FIGS. 1A to 2C show an example of the socket connector 10.

The connector structure according to one embodiment of the present invention will be hereinafter described with taking the socket connector (below simply called "connector") as an example.

In the connector 10, as shown in FIG. 7, a terminal 1*a* is crimped onto a tip core wire of a cable 1, and contained in a housing 11 made of a resin.

Upon inserting the terminal 1*a* into the housing 11 from behind, lances 1*b* provided in the terminal 1*a* are engaged with a stopper 11*h* provided inside the housing 11.

The housing 11 has a main body 11*a*, a cylindrical portion 11*e* on which a front portion 12*a* of a rubber bushing 12 is elastically attached, and a fitting portion 11*i* fitted into the corresponding plug connector 20.

Figure 1A:
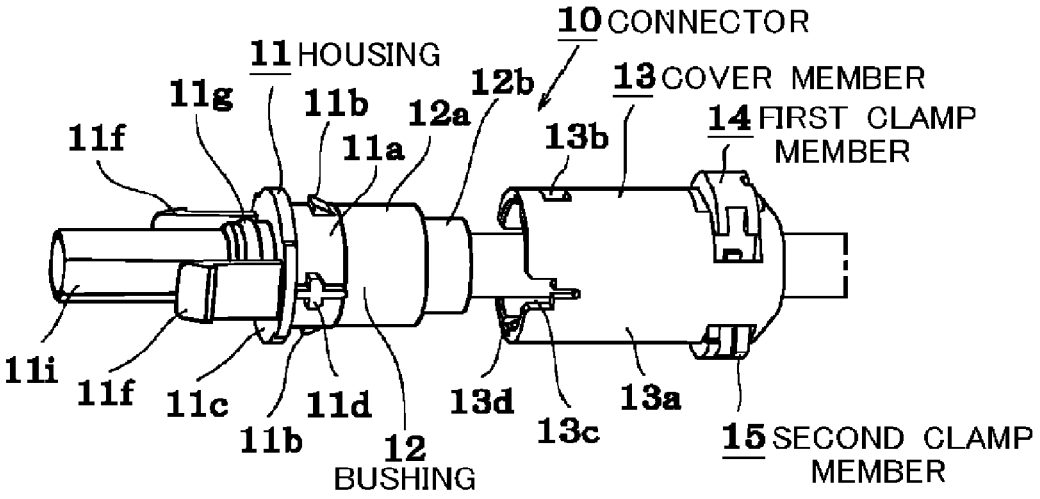
FIG. 1A shows an example of structure of a connector for cable connection according to one embodiment of the present invention, showing a state before a cover member is attached to a bushing, for the sake of explaining an attachment structure of the cover member.

As shown in FIG. 1A, the housing 11 has a flange 11*c*, stopper projections 11*b* engaged with stopper openings 13*b* provided in a cover member 13 described later, and positioning projections 11*d*.

Figure 6A:
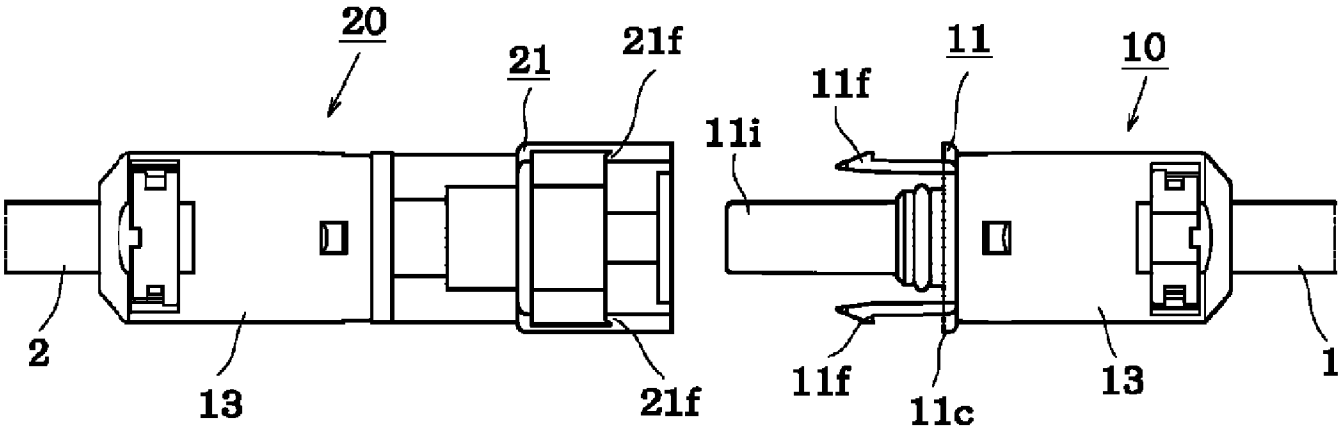
FIG. 6A shows an example applying a connector structure according to one embodiment of the present invention to a socket connector and a plug connector, showing a state before being fitted.
Figure 6B:
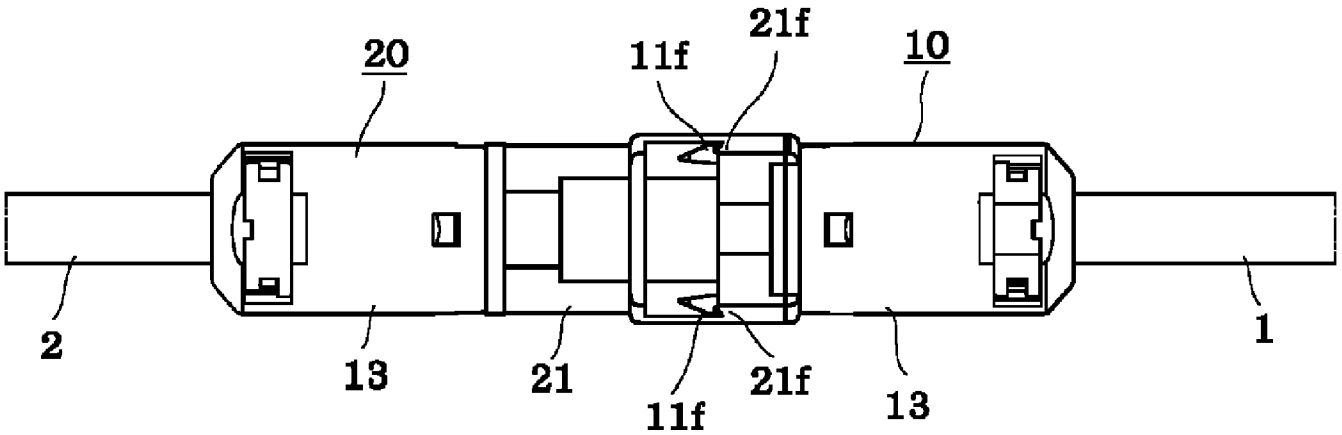
FIG. 6B shows an example applying a connector structure according to one embodiment of the present invention to a socket connector and a plug connector, showing a state after being fitted.

The housing 11 has an O-ring 11*g* fitted onto a proximal end of the fitting portion 11*i*, which is fitted into the plug connector 20, to seal a gap between the fitting portion 11*i* and the plug connector 20. As shown in FIG. 6B, hooks 11*f* are engaged with a stopper 21*f* provided in a housing 21 of the plug connector 20, so as to couple the housing 11 to the housing 21 of the plug connector 20.

Note that, a coupling structure between the connector 10 and the plug connector 20 is not limited thereto, and various types of structures are adoptable.

By inserting the cable 1 having the crimped terminal 1*a* into the bushing 12 from behind, a rear portion 12*b* of the bushing 12 elastically and tightly makes contact with the outer periphery of the cable 1. The front portion 12*a* of the bushing 12 is elastically attached to the cylindrical portion 11*e* of the housing 11.

Figure 1B:
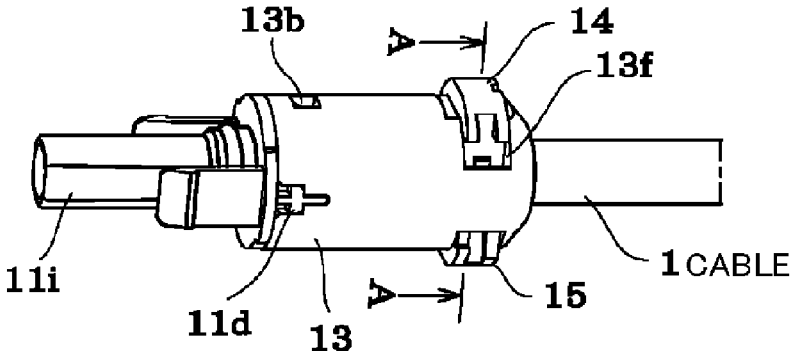
FIG. 1B shows an example of structure of a connector for cable connection according to one embodiment of the present invention, showing a state in which a cable is inserted into the connector from behind in a state of pre-fitting a first clamp member and a second clamp member to the cover member.

FIG. 1A shows a state in which the cover member 13 is detached from the housing 11, for the sake of explanation. However, in fact, the cable 1 is inserted from behind into and connected to the housing 11 with the cover member 13 attached thereto, as shown in FIG. 1B.

The bushing 12 is elastically attached to the cylindrical portion 11*e* of the housing 11 and the outer periphery of the cable 1 thereacross, so as to seal a gap between the cable 1 and the housing 11.

Figure 2A:
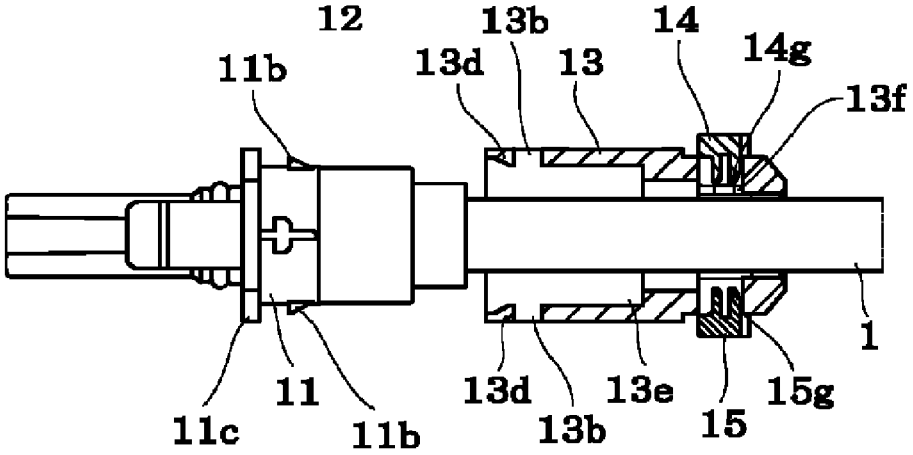
FIG. 2A shows a longitudinal cross-sectional view of FIG. 1A.
Figure 2B:
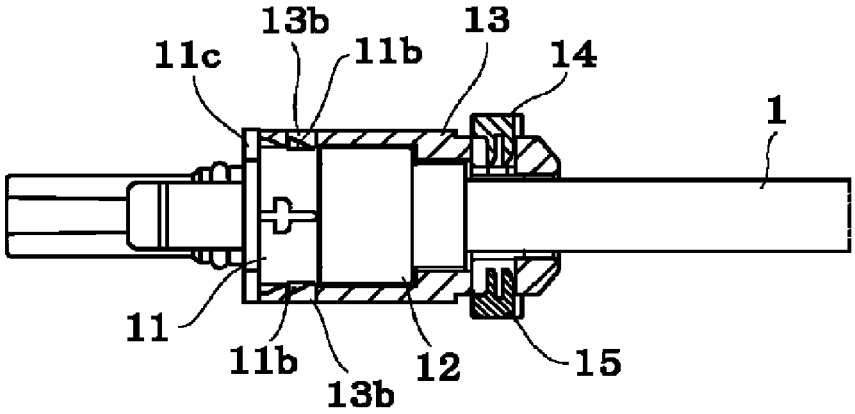
FIG. 2B shows a longitudinal cross-sectional view of FIG. 1B.
Figure 2C:
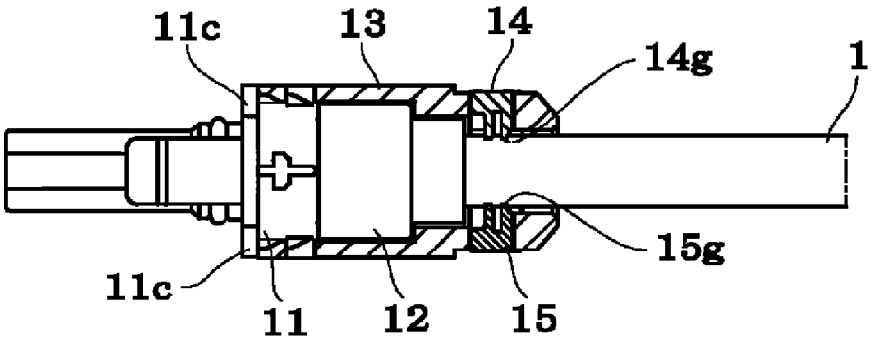
FIG. 2C shows a longitudinal cross-sectional view of FIG. 1C.
Figure 3A:
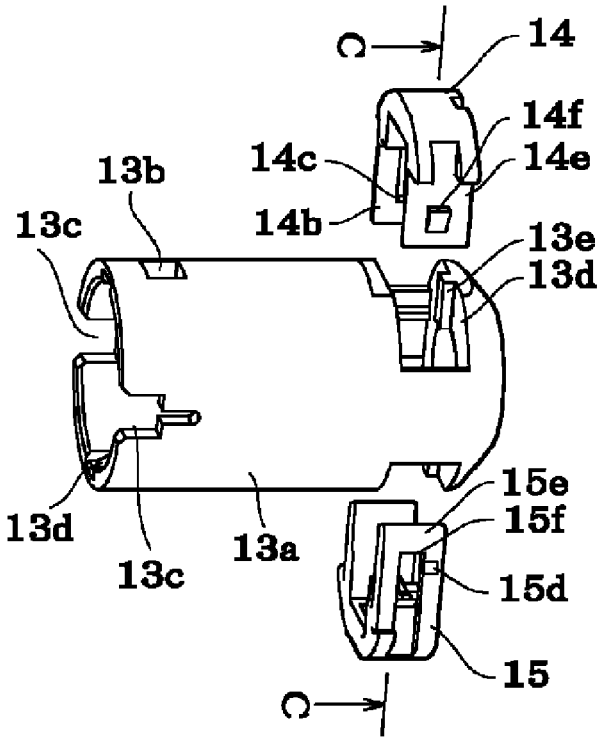
FIG. 3A shows a state before attaching the first and second clamp members to the cover member.
Figure 3B:
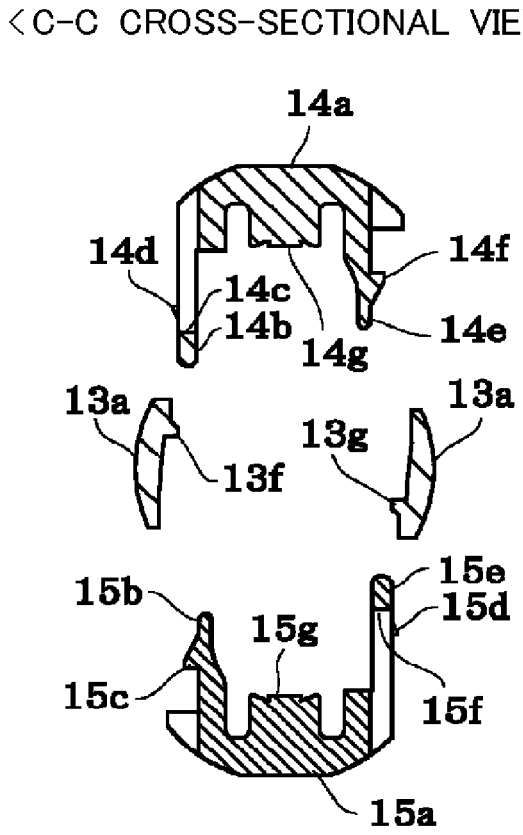
FIG. 3B shows a state before attaching the first and second clamp members to the cover member, showing cross-sectional view along line C-C in FIG. 3A.

As shown in FIGS. 2A to 2C, the cover member 13 is attached so as to cover the bushing 12. As shown in FIGS. 3A and 3B, the cover member 13 has at its rear side attachment openings 13*d* to which a first clamp member 14 and a second clamp member 15 are attached.

FIGS. 5A to 5E are perspective views of the first and second clamp members 14 and 15. FIGS. 3B, 3D, 4A and 4B are cross-sectional views of the first and second clamp members 14 and 15.

Figure 1C:
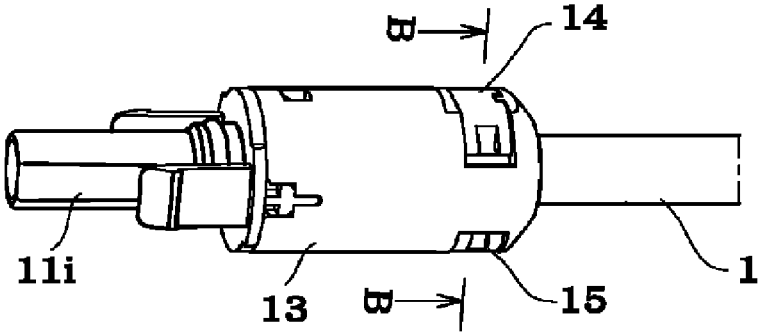
FIG. 1C shows an example of structure of a connector for cable connection according to one embodiment of the present invention, showing a state in which the first clamp member and the second clamp member are inserted into each other to clamp the cable.
Figure 3C:
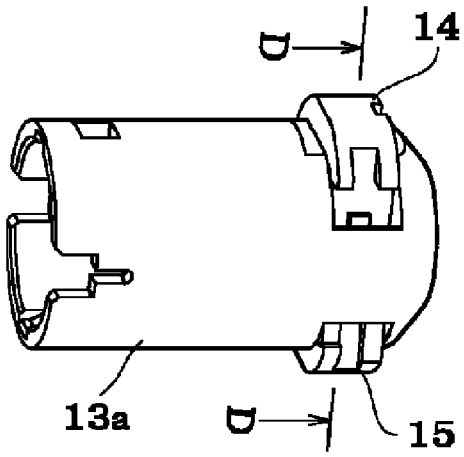
FIG. 3C shows a state in which the first clamp member and the second clamp member are attached to the cover member in a pre-fitted state.
Figure 3D:
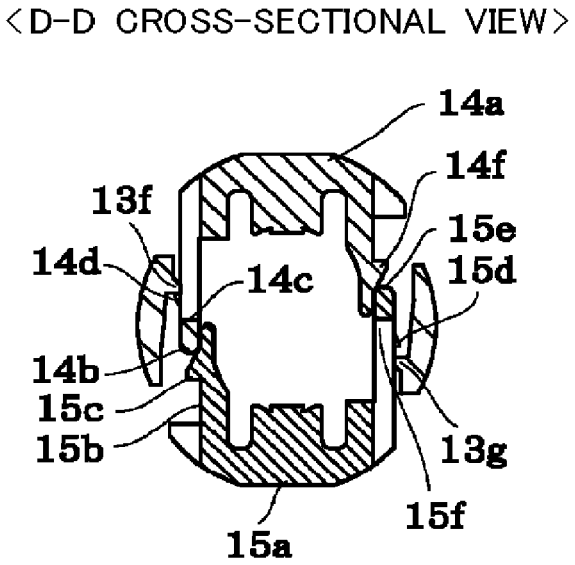
FIG. 3D shows a state in which the first clamp member and the second clamp member are attached to the cover member in a pre-fitted state, showing cross-sectional view along line D-D in FIG. 3C.

The first and second clamp members 14 and 15 have fitting portions that are fitted to each other. The first clamp member 14 and the second clamp member 15 constitute a two-step fitting structure having a pre-fitted state in which the first clamp member 14 and the second clamp member 15 are attached to the cover member 13 with the tops thereof protruding from the attachment openings 13*d* of the cover member 13 as shown in FIGS. 3C and 3D, and a fitted state in which the first clamp member 14 and the second clamp member 15 catch and clamp the outer periphery of the cable 1 as shown in FIGS. 1C and 4B.

Figure 5A:
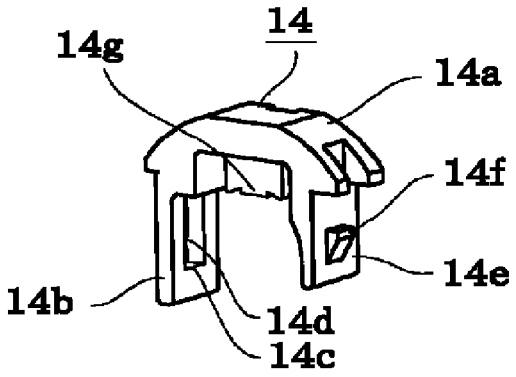
FIG. 5A shows the first clamp member.
Figure 5B:
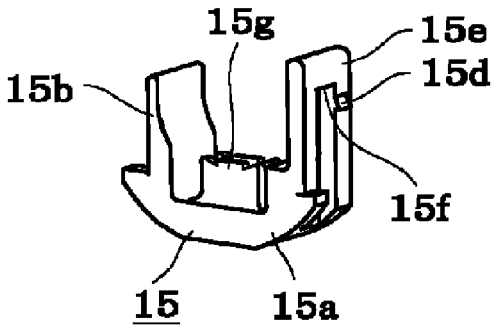
FIG. 5B shows the second clamp member.
Figure 5C:
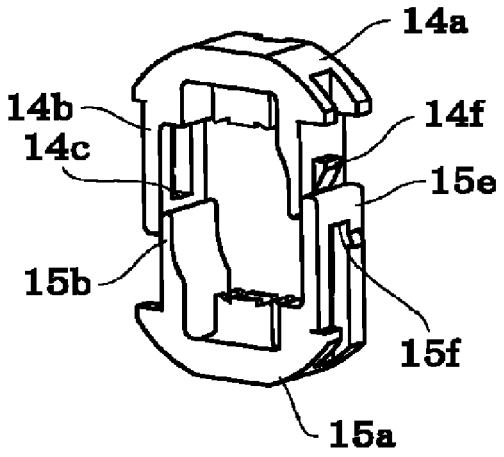
FIG. 5C shows positional interrelationship between the first clamp member and the second clamp member.
Figure 5D:
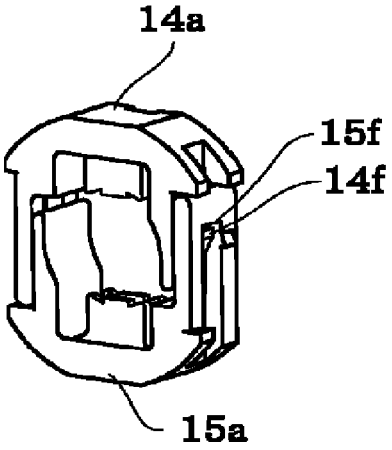
FIG. 5D shows a fitted state of the first clamp member and the second clamp member.
Figure 5E:
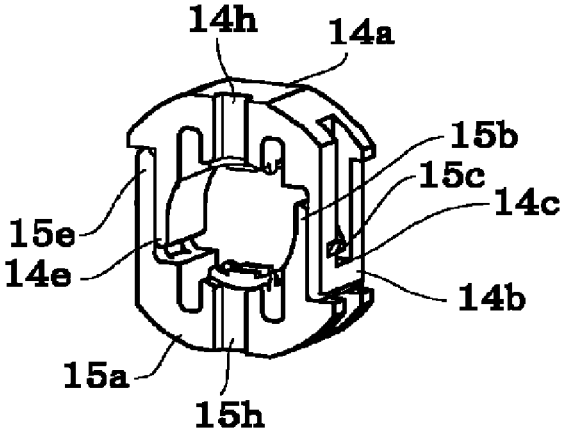
FIG. 5E is a perspective view viewed from an opposite side from FIG. 5D.

As shown in FIG. 5E, the first clamp member 14 and the second clamp member 15 have guide grooves 14*h* and 15*h*, respectively, at side surfaces. The first clamp member 14 and the second clamp member 15 are inserted such that the guide grooves 14*h* and 15*h* slide along slide projections 13*e* of the cover member 13.

The first clamp member 14 has a pair of fitting pieces 14*b* and 14*e* extending from a base portion 14*a*. The one fitting piece 14*b* is provided with an opening formed therein, and a stopper 14*c* is provided to a wall of the opening. The other fitting piece 14*e* has a tab-shaped stopper projection 14*f*.

The fitting piece 14*b* also has a projection 14*d* that climbs over a restriction projection 13*f* formed inside a main body 13*a* of the cover member 13 and prevents the first clamp member 14 from being pulled out of the cover member 13.

The second clamp member 15 has a pair of fitting pieces 15*b* and 15*e* extending from a base portion 15*a*, so as to correspond to the first clamp member 14. The one fitting piece 15*b* is provided with a stopper projection 15*c*. The other fitting piece 15*e* is provided with a stopper 15*f* to a side wall of an opening formed in the fitting piece 15*e*. The fitting piece 15*e* has a projection 15*d* that climbs over a restriction projection 13*g* formed in the cover member 13 and prevents the second clamp member 15 from being pulled out of the cover member 13.

Figure 4A:
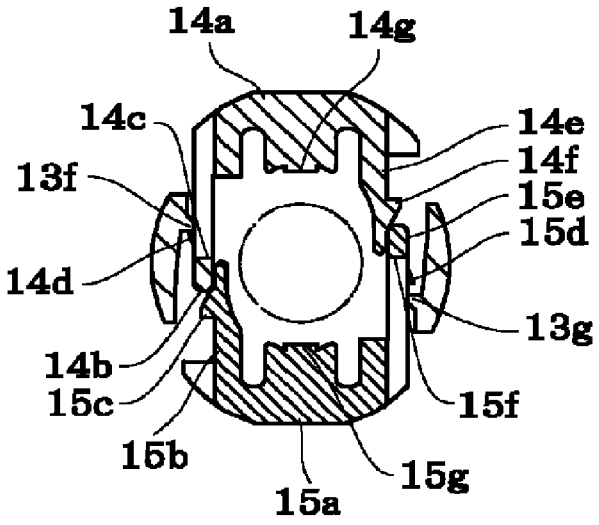
FIG. 4A is a cross-sectional view taken along line A-A in FIG. 1B.
Figure 4B:
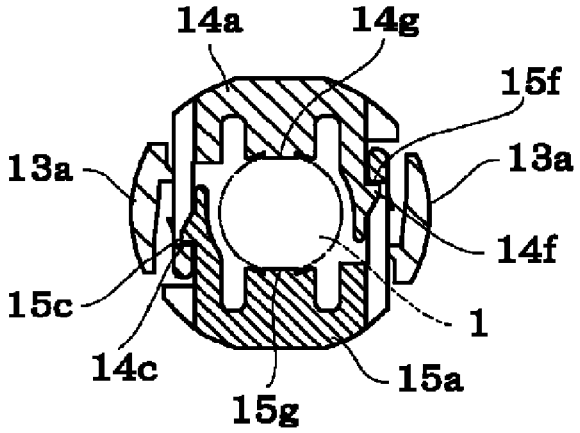
FIG. 4B is a cross-sectional view taken along line B-B in FIG. 1C.

With this configuration, the first clamp member 14 and the second clamp member 15 are attached to the cover member 13 in the pre-fitted state, as shown in FIG. 4A, in which the projection 14*d* of the first clamp member 14 and the projection 15*d* of the second clamp member 15 climb over the restriction projections 13*f* and 13*g* inside the cover member 13, respectively.

In this state, as shown in FIG. 4A, larger space than the outside diameter of the cable 1 is formed inside, so that the cable 1 can be inserted thereinto from behind.

Pushing the base portion 14*a* of the first clamp member 14 and the base portion 15*a* of the second clamp member 15 in each other in a state that the cable 1 is inserted into the housing 11, as shown in FIG. 4B, makes the stopper projection 14*f* of the first clamp member 14 engage with the stopper 15*f* of the second clamp member 15 and the stopper projection 15*c* of the second clamp member 15 engage with the stopper 14*c* of the first clamp member 14, and therefore clamps the cable 1 from above and below.

Thereby, a clamp portion 14*g* of the first clamp member 14 and a clamp portion 15*g* of the second clamp member 15 catch and clamp the outer periphery of the cable 1, so that the cable 1 is prevented from moving in a pullout direction.

In the connector according to one embodiment of the present invention, since the first and second clamp members 14 and 15 of the connector 10 are attached in the pre-fitted state, the connector 10 can be brought in a field in this state. In the field, the cable 1 having the terminal 1*a* crimped at an end is inserted into the housing 11 from behind and engaged therein using the lance, and then clamped in this state by pushing the first and second clamp members 14 and 15 in each other.

Therefore, it is possible to facilitate cable connection in the field, and hence reduce man-hours needed for the connection.

REFERENCE SIGNS LIST

1 cable
10 connector
11 housing
12 bushing
13 cover member
14 first clamp member
15 second clamp member

The invention claimed is:

1. A waterproof connector for cable connection, comprising:

a housing having a cylindrical portion for allowing a cable to which a terminal is connected to be attached thereto;

a waterproof bushing;

a cover member; and a clamp member, wherein:

in a state that the cable is attached to the housing through the cylindrical portion, a front portion of the bushing is elastically attached to an outer periphery of the cylindrical portion, and a rear portion of the bushing is elastically attached to an outer periphery of the cable;

the cover member has an attachment portion for the clamp member;

the clamp member attached to the attachment portion clamps the cable;

the clamp member clamps the cable by fitting a first clamp member and a second clamp member to each other;

the first clamp member and the second clamp member constitute a two-step fitting structure having a pre-fitting portion and a fitting portion;

the first clamp member and the second clamp member are attached to the attachment portion of the cover member in a state of fitting the pre-fitting portion; and after the cable is inserted into and attached to the housing, the first clamp member and the second clamp member are fitted to each other by the fitting portion to clamp the cable.

* * * * *